US010076178B2

(12) United States Patent
Stapf et al.

(10) Patent No.: US 10,076,178 B2
(45) Date of Patent: Sep. 18, 2018

(54) INDEPENDENT HAMMOCK SUSPENSION SYSTEM

(71) Applicants: Seth Vaughan Stapf, Asheville, NC (US); Charles Gray Whicker, Jr., Athens, GA (US)

(72) Inventors: Seth Vaughan Stapf, Asheville, NC (US); Charles Gray Whicker, Jr., Athens, GA (US)

( * ) Notice: Subject to any disclaimer, the term of this patent is extended or adjusted under 35 U.S.C. 154(b) by 203 days.

(21) Appl. No.: 15/242,523

(22) Filed: Aug. 20, 2016

(65) Prior Publication Data

US 2018/0049540 A1 Feb. 22, 2018

(51) Int. Cl.
*A45F 3/22* (2006.01)
*A45F 3/24* (2006.01)

(52) U.S. Cl.
CPC . *A45F 3/22* (2013.01); *A45F 3/24* (2013.01)

(58) Field of Classification Search
CPC ..... A45F 3/22; A45F 3/24
USPC ..... 5/120, 122, 123, 127
See application file for complete search history.

(56) References Cited

U.S. PATENT DOCUMENTS 221,754 A * 11/1879 Travers ..... 5/122
271,510 A * 1/1883 Palmer ..... 5/122
271,767 A * 2/1883 Bates ..... 5/123
272,311 A * 2/1883 Palmer ..... 5/122
317,291 A * 5/1885 Brock ..... 5/123
325,048 A * 8/1885 Brock ..... 5/123
333,377 A * 12/1885 Adams ..... 5/123
337,815 A * 3/1886 Cook ..... 5/123
374,776 A * 12/1887 Campbell ..... 5/123
408,207 A * 8/1889 Brayshaw ..... 5/120
451,186 A * 4/1891 Patterson ..... 5/123
468,576 A * 2/1892 Palmer ..... 5/123
469,869 A * 3/1892 Palmer ..... 5/123
483,930 A * 10/1892 Knight ..... 5/123
492,852 A * 3/1893 Travers ..... 5/123
501,944 A * 7/1893 Hines ..... 5/122
518,568 A * 4/1894 Funke ..... 5/123
566,180 A * 8/1896 Irish ..... 5/122
595,794 A * 12/1897 Sutton et al. ..... 5/122
597,227 A * 1/1898 Thiele ..... 5/122
699,410 A * 5/1902 Palmer ..... 5/123
700,978 A * 5/1902 Palmer ..... 5/122
725,475 A * 4/1903 Palmer ..... 5/123
756,520 A * 4/1904 Palmer ..... 5/123
(Continued)

*Primary Examiner* — Robert G Santos

(57) ABSTRACT

An improved hammock suspension system is provided which is both laterally stable and flat, and suspended between two spaced trees by longitudinally elongated web straps coupled to an independent anchor strap, one at each end. These longitudinally elongated web straps are affixed to each longitudinal side edge and extend a distance beyond the opposing hammock body ends, creating four web extensions. These web extensions extend a distance to accommodate spreader member receptacles which secure horizontal, rigid spreader members, thus transferring load forces along opposing longitudinal edges, creating a flatter sleeping platform. The extensions also accommodate fasteners, creating four points of connection and coupling the elongated web strap extensions to an independent web strap anchored to a tree by passing the strap around the tree at minimum 540 degrees, fully encircling and anchoring the strap to the tree and preventing slippage, while also alleviating torsional roll.

11 Claims, 9 Drawing Sheets

(56) References Cited

U.S. PATENT DOCUMENTS 787,633 A * 4/1905 Palmer ..... 5/123
803,091 A * 10/1905 Brayshaw ..... 5/122
810,942 A * 1/1906 Hohlfeld ..... 5/122
922,023 A * 5/1909 McBride ..... 5/123
964,452 A * 7/1910 Palmer ..... 5/123
1,814,579 A * 7/1931 Fletcher ..... A45F 3/22 5/122
1,917,518 A * 7/1933 Goudie ..... A45F 3/22 5/120
2,569,596 A * 10/1951 Anderegg ..... A45F 3/24 5/122
4,198,045 A * 4/1980 Miller ..... A63B 21/023 482/130
4,686,720 A * 8/1987 Newell ..... E04H 15/04 5/121
5,293,657 A * 3/1994 DeAth ..... A62B 35/0068 182/9
5,579,548 A * 12/1996 Death ..... A45F 3/24 5/120
5,729,845 A * 3/1998 Hsu ..... A45F 3/24 5/120
6,003,173 A * 12/1999 Meoli, Jr. ..... A45F 3/22 5/120
6,314,594 B1 * 11/2001 Meoli, Jr. ..... A45F 3/22 5/120
6,711,763 B2 * 3/2004 Batchelder ..... A45F 3/22 5/120
6,782,570 B1 * 8/2004 Bhatt ..... A45F 3/22 5/120
6,957,453 B2 * 10/2005 Branch, III ..... A45F 3/22 5/122
7,788,745 B1 * 9/2010 Beaton ..... A45F 3/22 5/120
8,161,991 B2 * 4/2012 Johnson ..... E04H 15/04 135/90
8,943,623 B2 * 2/2015 Watkins ..... A45F 3/24 5/120
9,032,568 B2 * 5/2015 Roney ..... A45F 3/22 5/122
2003/0028962 A1 * 2/2003 Batchelder ..... A45F 3/22 5/120
2004/0154098 A1 * 8/2004 Bhatt ..... A45F 3/22 5/122
2005/0132492 A1 * 6/2005 Orians ..... A45F 3/22 5/122
2005/0144719 A1 * 7/2005 Branch, III ..... A45F 3/22 5/122
2005/0188460 A1 * 9/2005 O'Brien ..... A45F 3/22 5/121
2009/0065036 A1 * 3/2009 Johnson ..... A45F 3/22 135/95
2013/0269104 A1 * 10/2013 Roney ..... A45F 3/24 5/122
2014/0289962 A1 * 10/2014 Watkins ..... A45F 3/24 5/123
2018/0049540 A1 * 2/2018 Stapf ..... A45F 3/22

* cited by examiner 10
12
14
16
18
20
22
24
26
28
30
32
34
36
38
40
42
44
46
48
50
52
54
56
58
60
62
64
66
68
70
72
74
76
78
80
82
84
86
88
90

INDEPENDENT HAMMOCK SUSPENSION SYSTEM

FIELD OF THE INVENTION

This invention relates to hammocks and, more precisely, to an improved hammock suspension method for a more laterally stable and flatter sleeping platform between a pair of spaced trees or similar upright load-bearing supports.

BACKGROUND OF THE INVENTION

For the outdoor enthusiast, hammocks have been developed to provide a more comfortable and drier sleeping shelter than tents. Hammocks are also advantageous in uneven terrain and areas inhabited by ground dwelling animals. There are typically two conventional hammock constructions:

The first method requires that the longitudinal ends of the hammock be laterally bunched and then suspended at each end by a load-bearing member—typically a rope or web strap—where one end of the member is connected to the hammock body itself and the opposite ends are connected to two spaced trees or similar upright load-bearing supports.

The second method utilizes horizontal, rigid spreader members (known as 'spreader bars' in the art) affixed to the hammock body ends with merging support straps extending from the spreader members, which converge to a single point of suspension. At this point they are coupled to a load-bearing support strap—typically a rope or web strap—through which the suspension forces of the hammock pass. These members are then attached to two spaced trees or similar upright load-bearing supports.

Both of these methods of hammock suspension create a laterally unstable condition along the single axis of the support member, particularly while entering and exiting the construction. This can cause dangerous lateral rolling and pitching around the single support strap. Other designers have attempted to create hammock stability by directing the strap around the tree, creating two longitudinal support axes at both ends, as opposed to the conventional single support axis. A typical example of this method is illustrated in U.S. Pat. No. 6,711,763 of Crazy Creek Products; however, this design does not utilize such a spreader member. Crazy Creek Products opts to omit the spreader member to reduce overall hammock weight, which causes the hammock ends to bunch laterally; thus, creating a cocooning, squeezing effect around the occupant. This squeezing can lead to what is known in the art as "shoulder pinch", which can cause discomfort when resting for an extended period. An additional drawback to this design is that the farther away the hammock ends are placed from the trees the more unstable the construction becomes laterally. Without the spreader members, the stability of the hammock becomes dependent on distance from the upright anchor source. The suspension forces become increasingly longitudinally diagonal the farther the hammock ends are moved from the tree. This creates a condition in which the hammock becomes laterally unstable about the longitudinal axis as seen in conventional, single-axis hammock suspensions. Additionally, both conventional methods of hammock suspensions create a sleeping platform which sags, leading to an uncomfortable curve to the occupant's back due to the resulting concave shape of the hammock sleeping platform as viewed from above. This concave shape also restricts the occupant to sleeping only on his/her back. Other hammock designers have attempted to alleviate the uncomfortable sag by creating a flatter sleeping platform. A typical example of this is illustrated in U.S. Pat. No. 6,865,757 of Hennessy; however, Hennessy utilizes a non-equilateral polygon requiring the individual to lie diagonally across the suspension axis. This creates a somewhat precarious sleeping configuration.

In addition to the unstable condition associated with conventional hammock suspension methods, the user is required to possess knowledge of advanced knot-tying in order to properly and safely secure the hammock; this is beyond the skill scope of the average user. An additional drawback of conventional hammocks is the lack of storage space for personal effects. A tent allows the occupant to place personal items inside the tent where they remain safe from the elements. Traditional hammocks require the user to either place all personal effects loosely in the hammock—which can make sleeping uncomfortable and items difficult to locate—or leave them outside of the hammock, both unprotected and out of reach.

Lastly, the method used to attach a hammock utilizing only one pass around the tree can damage the tree surface due to rubbing at the point from which the hammock is suspended. This sort of tree damage can lead to disease, which is environmentally irresponsible. Other hammock designs have attempted to achieve an environmentally sound method of hammock suspension as illustrated in U.S. Pat. No. 6,711,763 of Crazy Creek Products; however, the support strap has only one point of connection, allowing only a single 180 degree of travel around the tree which does not anchor the support line to the tree and can still allow rubbing to occur.

SUMMARY OF THE INVENTION

Accordingly, in view of the foregoing, there is a need for a hammock which overcomes the disadvantages of the prior art. More specifically, an object of the present invention is to laterally stabilize a hammock about the longitudinal axis which is suspended between two spaced trees (or similar upright load-bearing supports) in order to lessen the lateral rotation about the longitudinal axis, alleviating torsional roll heretofore associated with the conventional single axis support. Another object of the present invention is to reduce the traditional sag resulting in a flatter sleeping configuration, allowing for multiple sleeping positions including back, stomach and side.

Yet another object of the present invention is to lessen wear on the trees at the point of connection. Our invention utilizes elongated webbing that is wider than it is thick, affixed to the opposing longitudinal fabric body edges and extending beyond the hammock body, a distance that will allow for spreader member pockets and anchor strap coupling fasteners. These attachment fasteners will couple the web extensions to an independent web member of like material that is wrapped around the tree a minimum of 540 degrees, thus fully encircling the tree and resulting in two support member extensions. Henceforth two longitudinal suspension axes increasing lateral stability about the longitudinal axis. Additionally, this method anchors the attachment strap to the tree, thus preventing slippage and alleviating the rubbing of the anchor strap to the tree inherent in a conventional configuration. This is a more environmentally responsible method as opposed to the conventional single strap connection, which makes only a 180 degree pass around the tree which can rub the area of connection, thus damaging the tree surface and leading to disease.

Our invention has four connection points, two at each longitudinal end. The longitudinal web extensions are coupled to the independent anchor web strap extensions by running the two independent anchor strap extensions through the fasteners and pulling the resulting tabs to the desired tautness, creating a safe, level, and flat sleeping configuration. This is accomplished without complicated knot tying skills which are required with most conventional hammock suspension configurations, and are beyond the skill scope of the average person. Once the hammock is suspended, horizontal, rigid spreader members are inserted into the receptacles affixed to the longitudinal web extensions. The spreader members direct the suspension forces from the spreader member ends longitudinally along the opposing longitudinally elongated hammock body edge webbing to the spreader member ends at the opposite end of the hammock. This method of construction makes hammock stability independent of the distance from the upright anchor supports, and creates a flatter sleeping platform, alleviating shoulder pinch. The spreader members are removed a distance from the hammock body which directs the longitudinal forces more along the opposing outer body edge longitudinally elongated web members, as opposed to diagonally from end corner to opposing end corner at the opposite end of the hammock. This is observed when the spreader member is affixed to the hammock body end.

Yet another object of the present invention is to anchor the attachment strap to a tree by fully encircling the tree and directing the two resulting strap ends to the web extensions, where they are coupled with the longitudinal web extensions utilizing fasteners, and thus further directing the load forces beyond the spreader member ends, which further directs the forces longitudinally along the opposing longitudinally elongated web members to the spreader member ends at the opposite end further directing the forces around the tree as seen on the other end. This method effectively constructs a continuous support system to which the fabric hammock body is affixed, creating a stable, easily adjusted and more flat sleeping platform.

An additional object of the present invention is to provide a hammock that may be suspended between two spaced trees without compromising the tree surface (which could lead to disease) by fully encircling the anchor strap around the tree at minimum 540 degrees, thus preventing slippage.

A further object of the present invention is to provide a hammock which may be suspended between two spaced upright, load-bearing supports without advanced knowledge of knot tying.

An additional object of the present invention is to alleviate shoulder pinch by utilizing displaced, horizontal, rigid spreader members which create a flatter sleeping platform.

In summary, we propose a hammock suspension system that is suspended between two spaced trees utilizing two longitudinally elongated web straps, to which the opposing longitudinal hammock body edges are affixed. These web straps extend a distance to create four web strap extensions. The web strap extensions are coupled to elongated web members of like material which extend from the independent anchor strap that fully encircles the tree. The web members will couple, utilizing adjustable fasteners, which create end tabs that allow for selectively leveling and tightening of the suspension system without complicated knot tying or adjusting the anchor strap. This creates four selectively adjustable points of connection, two per longitudinal end. Horizontal, rigid spreader members will be utilized to spread the web extensions, thus creating a continuous system of suspension. Thusly, achieving a more flat and stable suspension system which is independent of the hammock body.

Other and further objects of the present invention will appear in the description of the drawings.

BRIEF DESCRIPTION OF DRAWINGS

In the following description of the drawings, in which like reference numerals are employed to indicate like parts in the various views.

DETAILED DESCRIPTION OF THE INVENTION

Figure 1:
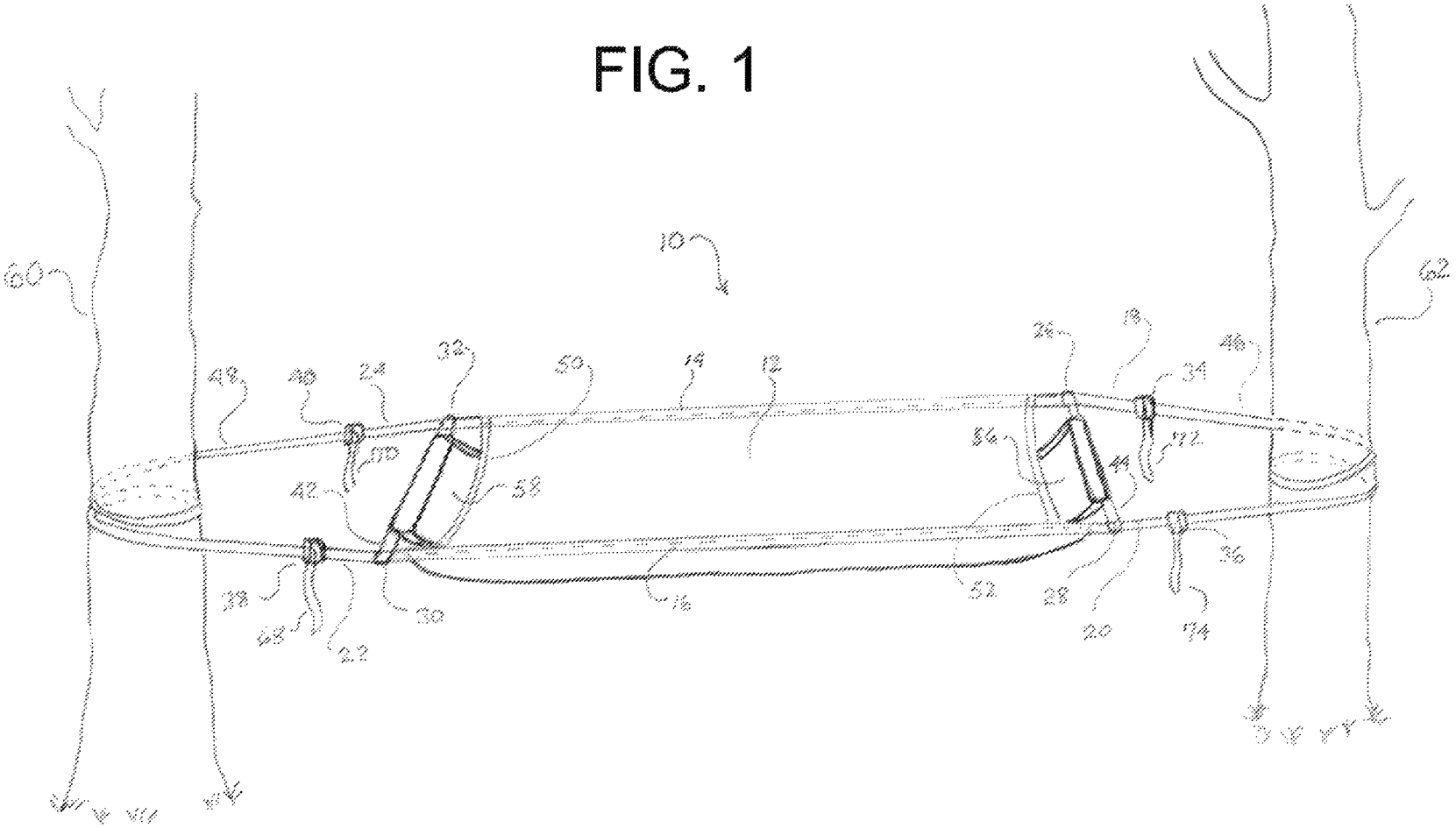
FIG. 1 is a perspective view of a hammock of the present invention shown suspended between a pair of spaced trees.

Referring now to the invention in greater detail, attention is first directed to FIG. 1 which illustrates a hammock 10 having a sleeping platform 12 held in a substantially flat and level position above the ground by two longitudinally elongated opposing body edge web straps, namely a first strap 14, and a second strap 16. Each of the straps 14, 16 is attached to the opposing longitudinal body edges of the hammock sleeping platform by sewing the platform's longitudinal edges to the longitudinally elongated web straps.

In further detail, still referring to the invention of FIG. 1, the sleeping platform 12 is sufficiently wide and long for comfortable sleeping, consisting essentially of a width and length required to accommodate the occupant.

The construction details of the invention as shown in FIG. 1 are that the hammock sleeping platform 12 will be made of flexible fabric sufficient in strength to support the occupant.

Referring to FIG. 1, there are shown two longitudinally elongated support straps 14, 16 made of webbing, that are significantly wider than they are thick, sewn to the opposing longitudinal body edges by essentially overlapping the body material, completely encasing the webbing and sewing.

In more detail, still referring to the invention of FIG. 1, the longitudinal body edge webbing is sufficiently extended on both ends, a distance that will allow for spreader bar receptacles 26, 28, 30, 32 and fasteners 34, 36, 38, 40.

In further detail, still referring to the invention of FIG. 1, two spreader bar receptacles per end 26, 28, 30, 32 that are sufficiently wide and deep to accommodate a horizontal, rigid spreader member 42, 44.

Referring to FIG. 1, there is shown a hammock 10 having a sleeping platform 12 held in a substantially flat and level position, elevated above the ground by four web extensions, namely a first extension 18, a second extension 20, a third extension 22, and a fourth extension 24. Each of the extensions are coupled to an independent anchor web strap 46, 48 with a fastener 34, 36, 38, 40. The independent anchor web straps 46, 48 are passed through the fasteners 34, 36, 38, 40 creating end tabs 68, 70, 72, 74 that can be pulled to the desired tautness.

Referring to FIG. 1, there are shown two longitudinal end pockets 56, 58 used to accommodate the occupant's personal effects.

Figure 2:
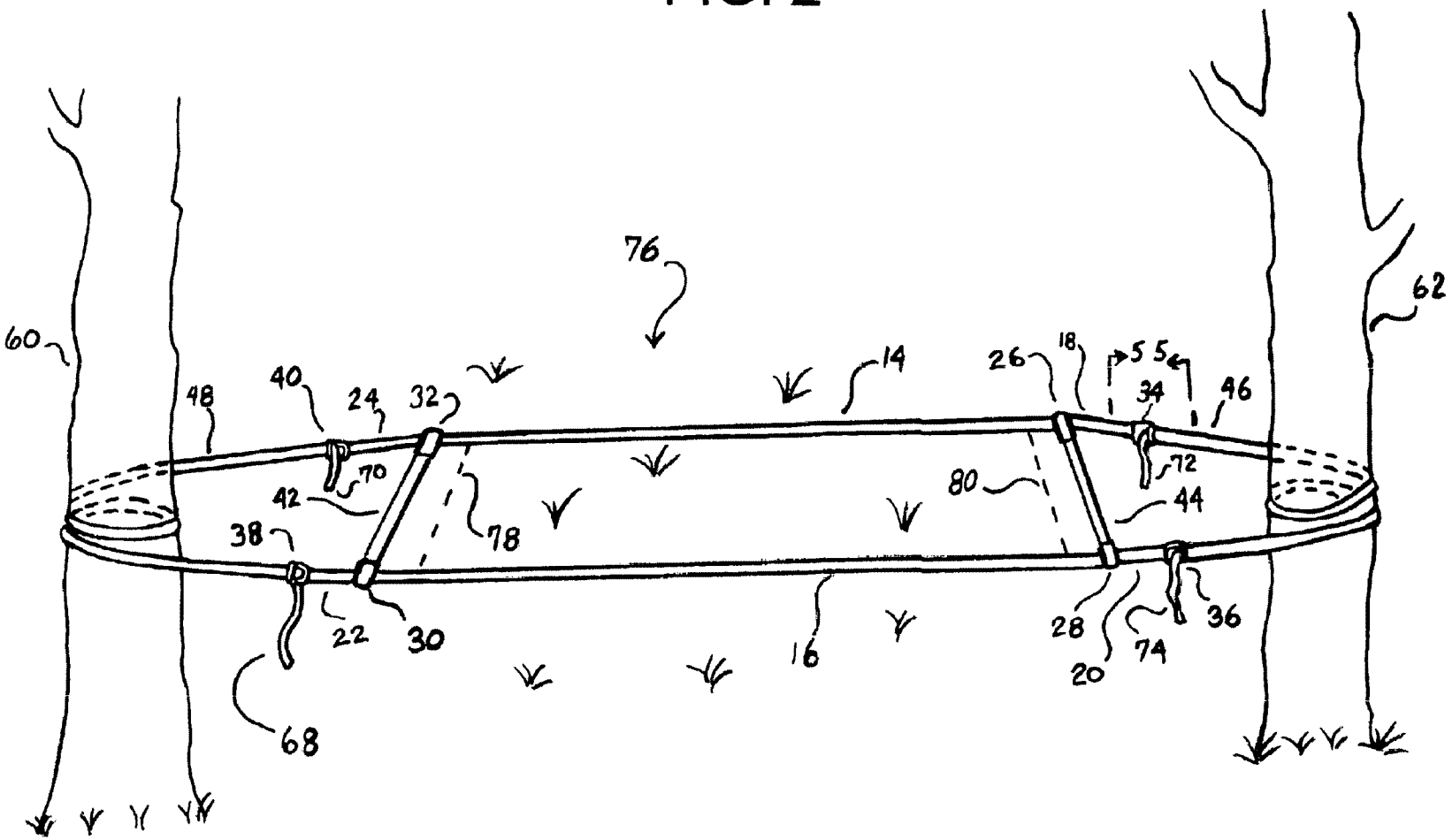
FIG. 2 is a perspective view of an independent hammock web suspension system of the present invention, without the hammock body, shown suspended between a pair of spaced trees.

Referring now to FIG. 2, there is shown a hammock suspension system 76 held in a substantially flat and level position elevated above the ground without the sleeping platform attached. The suspension system is constructed of two longitudinally elongated web straps 14, 16, two independent anchor web straps 46, 48 four fasteners 34, 36, 38, 40, four spreader member receptacles 26, 28, 30, 32 and two rigid spreader members 42, 44. The independent anchor web straps 46, 48 are coupled to the longitudinally elongated web strap extensions 18, 20, 22, 24 by passing the independent web straps 46, 48 through the fasteners 34, 36, 38, 40 creating end tabs 68, 70, 72, 74 which are pulled to the desired tautness, thus creating four adjustable points of connection. The horizontal, rigid spreader members 42, 44 are inserted into the spreader member receptacles 26, 28, 30, 32 thus laterally spreading the longitudinally elongated web straps. This creates a suspension system of continuous support independent of the sleeping platform and to which the sleeping platform is attached.

Figure 3:
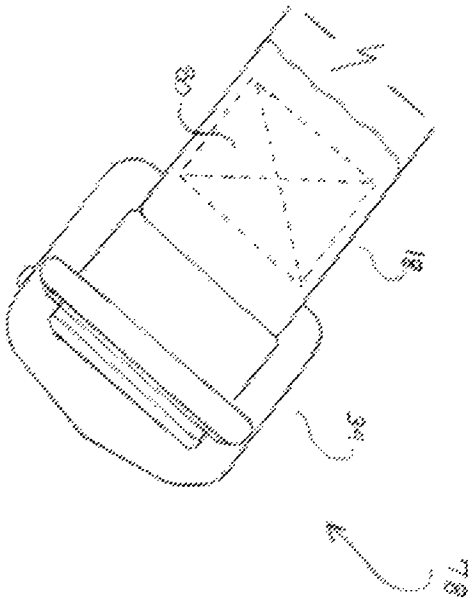
FIG. 3 is an exploded fragmentary view of the elongated web extension and coupling fastener taken along line 5-5 of FIG. 2. An illustration of the coupling fastener at one coupling point will suffice for all four points of suspension connection, as its construction is simply repeated at all four connection points.

Referring now to FIG. 3, there is shown a coupling apparatus 78 comprised of essentially a cinch buckle 34, which has been utilized in the art for many applications, and a longitudinally elongated web extension 18. The cinch buckle 34 will be attached to the longitudinally elongated web extension 18 by passing the ends of the longitudinally elongated web extension 18 through the cinch buckle 34. The longitudinally elongated web extension 18 will then be lapped over itself and sewn 80, thus attaching the cinch buckle 34 to the longitudinally elongated web extension 18.

Figure 4:
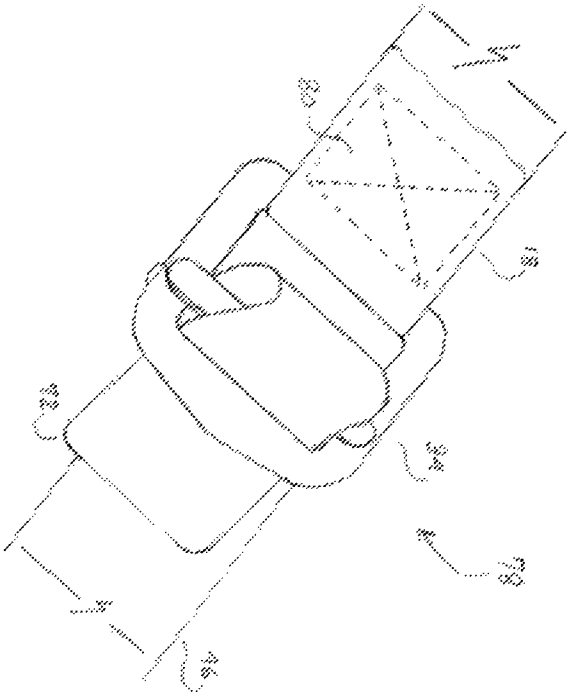
FIG. 4 is a sectional view of the coupling apparatus shown in FIG. 3. This view illustrates the method in which the independent anchor web extensions couple with the longitudinally elongated web extensions, by simply passing the independent anchor web extension through the buckle, creating end tabs.

Referring now to FIG. 4, there is shown a coupling apparatus 78, comprising a cinch buckle 34, a longitudinally elongated web extension 18, an independent anchor web strap extension 46 and an end tab 72. The independent anchor web extension is passed through the cinch buckle 34 creating an adjustable end tab 72.

Figure 5:
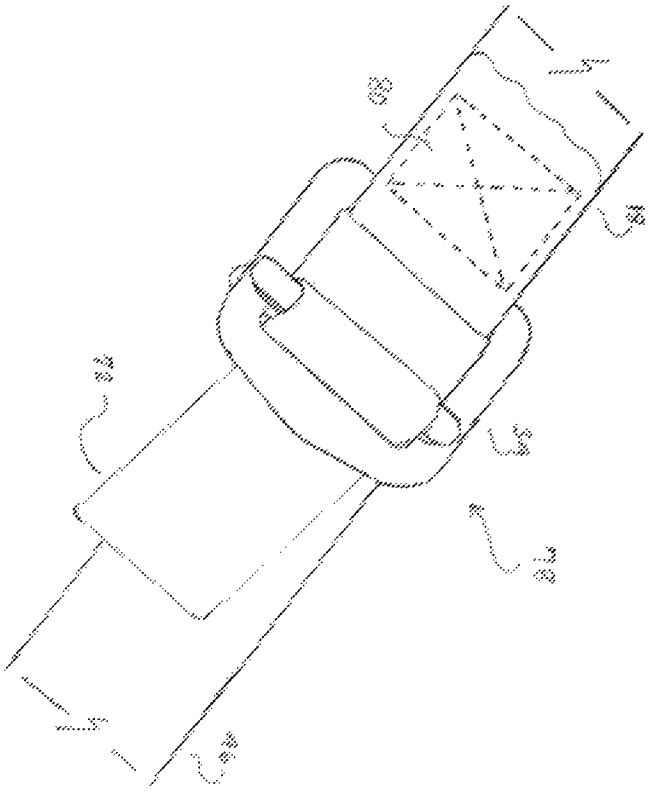
FIG. 5 is a sectional view of the coupling apparatus shown in FIG. 3 and FIG. 4. This view illustrates the end tab pulled to the desired tautness and locked in place.

Referring now to FIG. 5, there is shown a coupling apparatus 78. The end tab 72 is pulled to the desired tautness, thus easily securing and selectively leveling the hammock suspension system.

Figure 6:
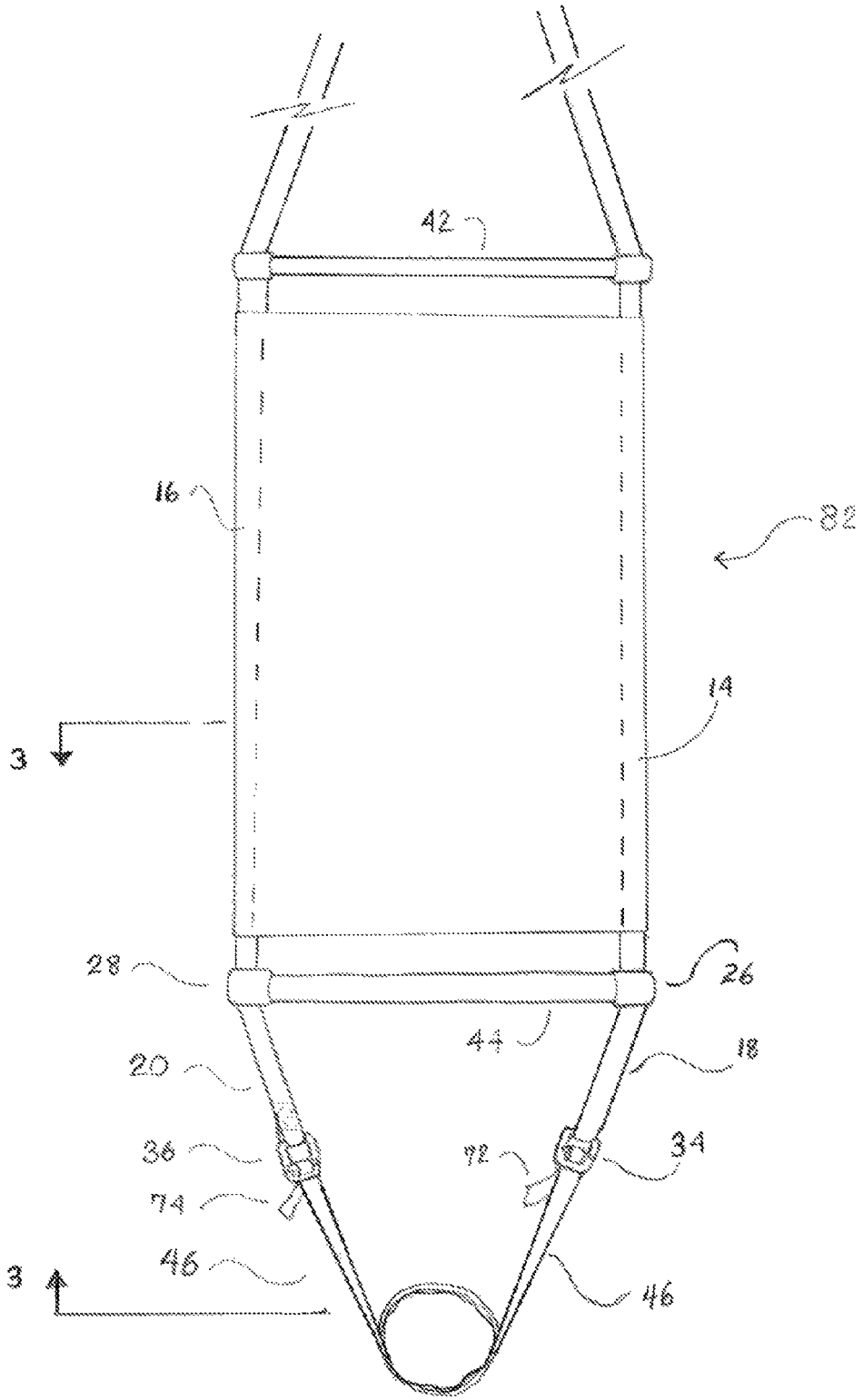
FIG. 6 is a fragmentary top plan view of the hammock shown suspended between a pair of spaced trees, without the end pockets.

Referring now to FIG. 6, there is shown a top plan view of the hammock 82. There are shown longitudinally elongated web straps 14, 16, spreader member receptacles 26, 28, web extensions 18, 20, coupling fasteners 34, 36, end tabs 72, 74, an independent anchor web strap 46, and horizontal, rigid spreader members 42, 44. The end pockets are removed for illustration purposes. A description of one end will suffice for the construction of the opposite end simply repeated.

Figure 7:
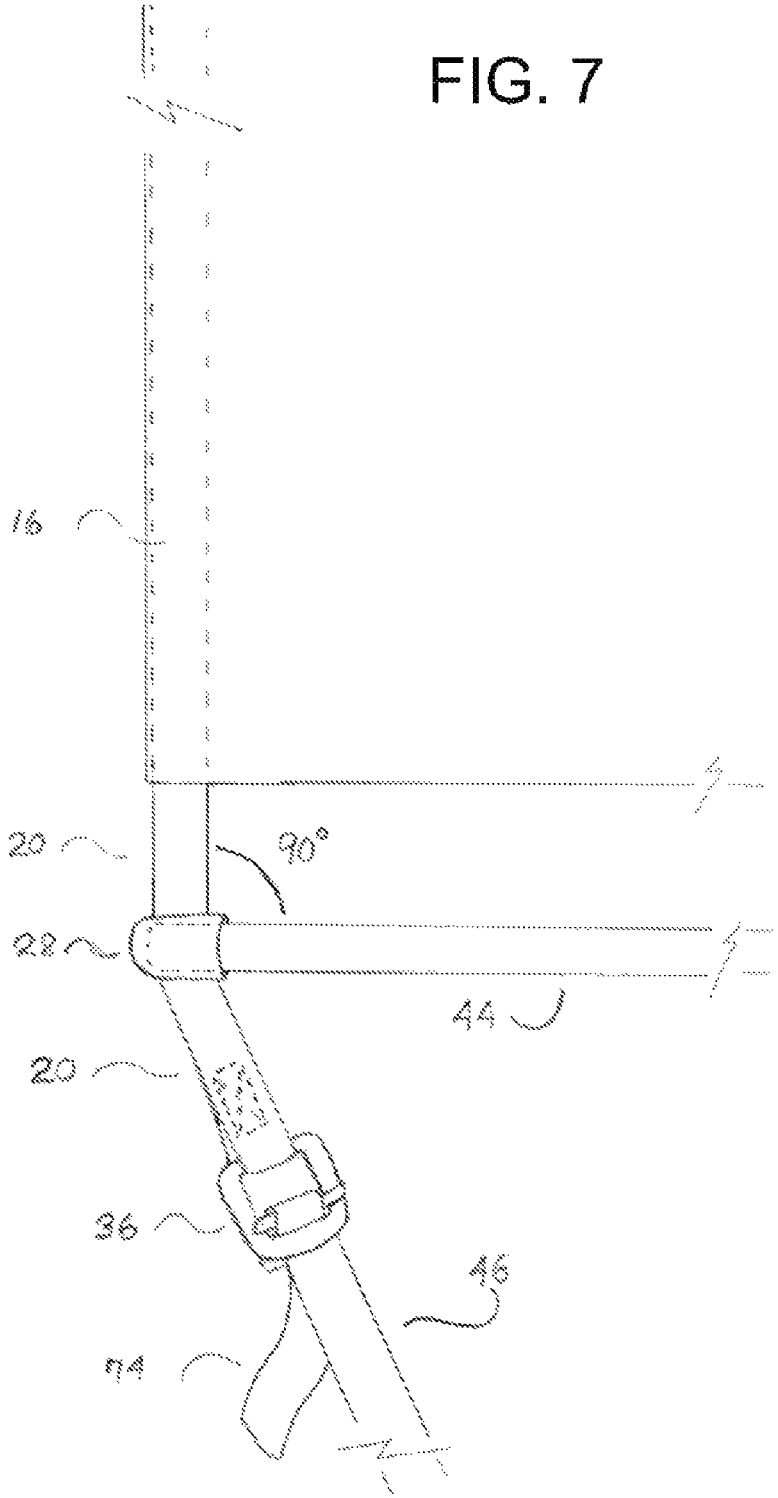
FIG. 7 is an exploded fragmentary top plan view of one corner of the hammock taken along line 3-3 of FIG. 6.

Referring now to FIG. 7, there is shown a longitudinally elongated web strap 16, a spreader member receptacle 28, a web extension 20, a coupling fastener 36, an end tab 74, an independent anchor web strap extension 46, and a horizontal, rigid spreader member 44. This view illustrates the ninety degree angle created between the horizontal, rigid spreader member and the longitudinally elongated web extension once the horizontal, rigid spreader member is placed within the receptacles. Therefore a zero degree suspension force line is created between the web extension 20 and longitudinally elongated edge webbing 16, once the horizontal, rigid spreader member 44 is inserted into receptacles 26, 28, thus spreading the web extensions. This method of construction directs the suspension forces in a straight line from the horizontal, rigid spreader member end, created by the horizontal, rigid spreader member 44 to the horizontal, rigid spreader member end at the opposite end of the hammock. This method of suspension results in two opposing longitudinally elongated web straps having the suspension forces directed along a straight line, from horizontal, rigid spreader member end to the horizontal, rigid spreader member end at the opposite end. This method of construction creates two taut longitudinally opposing web straps to which the hammock sleeping platform is attached, thus creating a longitudinally flat sleeping surface.

Figure 8:
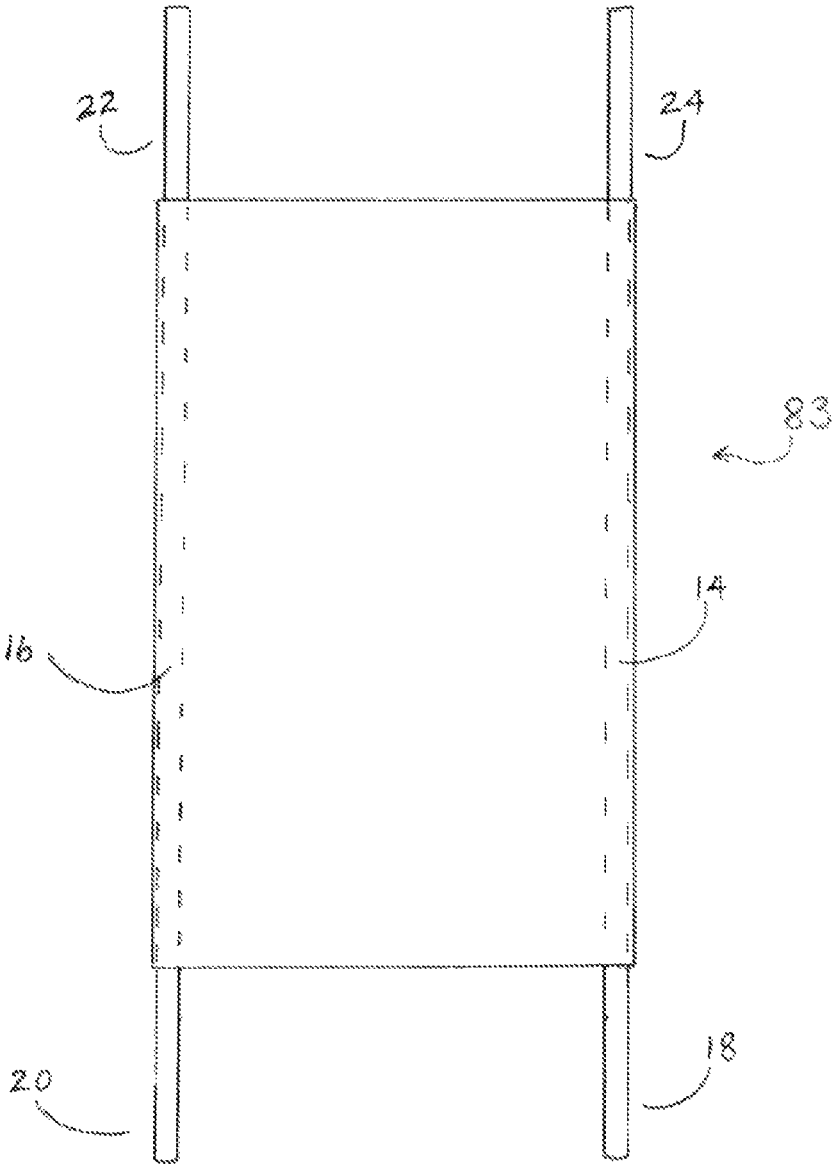
FIG. 8 is a top plan view of the hammock prior to suspension without the horizontal, rigid spreader member receptacles and coupling fasteners attached.

Referring now to FIG. 8, there is shown longitudinally elongated web straps 14, 16 sewn to the hammock's opposing longitudinal body edges. These longitudinally elongated straps 14, 16 extend beyond the sleeping platform to form web extensions 18, 20, 22, 24.

Figure 9:
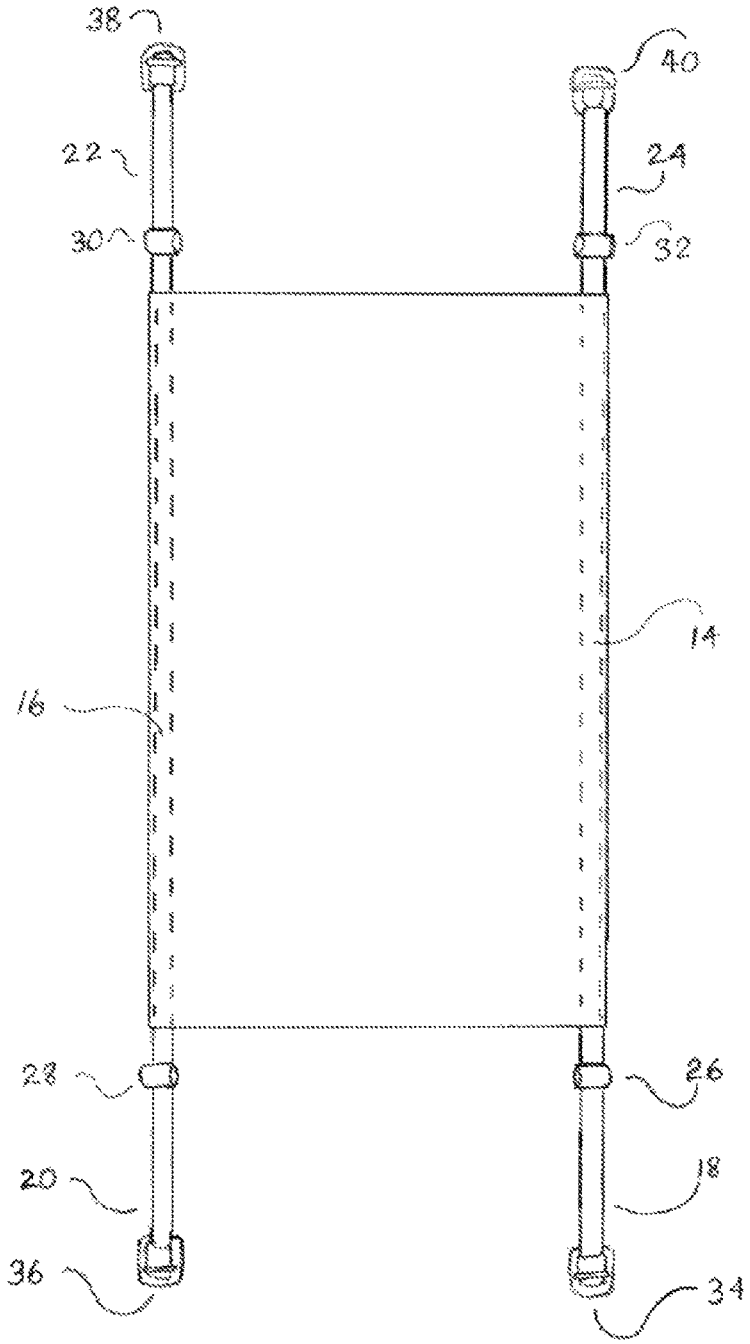
FIG. 9 is a top plan view of the hammock prior to suspension with the horizontal, rigid spreader member receptacles and coupling fasteners attached.

Referring now to FIG. 9, there is shown longitudinally elongated web straps 14, 16 sewn to the hammock's opposing longitudinal body edges, longitudinally elongated web extensions 18, 20, 22, 24, horizontal, rigid spreader member receptacles 26, 28, 30, 32, coupling fasteners 34, 36, 38, 40. This view illustrates the longitudinally elongated web extensions 18, 20, 22, 24 with the horizontal, rigid spreader member receptacles 26, 28, 30, 32, and the coupling fasteners 34, 36, 38, 40 attached. The horizontal, rigid spreader member receptacles 26, 28, 30, 32 will be displaced from the hammock sleeping platform approximately three inches.

NUMERALS

Hammock 10
Sleeping platform 12
Longitudinal side edges 14 & 16
Edge webbing extensions 18, 20, 22, & 24
Spreader member receptacles 26, 28, 30 & 32
Fasteners 34, 36, 38 & 40
Spreader members 42 & 44
Independent anchor webbing 46 & 48
Lateral edges 50 & 52
End pockets 56 & 58
Trees 60 & 62
Independent anchor strap end tabs 68, 70, 72 & 74
Suspension system 76
Coupling fastener 78
Web extension stitching 80
Plan view of suspended hammock 82
Plan view of hammock 83

PATENT CITATIONS

| Cited Patent | Filling Date | Publication Date | Applicant | Title |
|---|---|---|---|---|
| U.S. Pat. No. 6,865,757 | Jan. 6, 2003 | Mar. 15, 2005 | Thomas Hennessy | Asymmetrical hammock shelter |
| U.S. Pat. No. 6,711,763 | Aug. 13, 2001 | Mar. 30, 2004 | Robert F. Batchelder Robert D. Hart | Backpacker's hammock and ground bivy |

Having thus described our invention, we claim:

1. A hammock for suspension between two upright load-bearing supports, said hammock comprising:

A rectangular sleeping platform having a width and length sufficiently sized to support a reclined user, said sleeping platform having longitudinal side edges and lateral end edges; first and second longitudinal side edges having longitudinally elongated edge webbing, having greater width than thickness, sewn to said longitudinal side edges and extending beyond said lateral end edges of said sleeping platform an effective length to accommodate a fastener coupled to each end of said longitudinally elongated edge webbing, said fasteners being spaced apart from each other, and a receptacle secured to said longitudinally elongated edge webbing between and spaced apart from each of said ends of said longitudinally elongated edge webbing and said lateral end edges of said sleeping platform to accommodate a horizontal, rigid spreader member therein; each of said fasteners is adapted to be coupled to an independent anchor web member; and said independent anchor web members having a length to allow full encirclement of said upright load-bearing bearing supports and extending therefrom an effective length to couple with said longitudinally elongated edge webbing utilizing said fasteners and thus suspendingly support said hammock there between each of said upright load-bearing supports.

2. The hammock as in claim 1, said sleeping platform being constructed of flexible fabric and being sufficiently sized to support a reclined user.

3. The hammock as in claim 1, said longitudinally elongated edge webbing creating two web extensions per sleeping platform end, whereby said sleeping platform being suspended and attached to said longitudinally elongated edge webbing by overlapping said sleeping platform longitudinal side edge material, thus fully encasing said longitudinally elongated edge webbing and sewing.

4. The hammock as in claim 3, said fasteners coupled to the end of each web extension and being attached by passing said web extension end through said fastener and overlapping said webbing a sufficient length and sewing, thus securing said fastener to said web extension end.

5. The hammock as in claim 3, said horizontal, rigid spreader member receptacles being constructed of sturdy, flexible material, creating a pocket which is sewn to said web extensions; and said horizontal, rigid spreader members being received respectively within said spreader member receptacles.

6. The hammock as in claim 3, said spreader member receptacles will be removed from said sleeping platform a distance to achieve zero angle travel of applied suspension forces between said longitudinally elongated body edge webbing and said web extensions once said horizontal, rigid spreader member is received.

7. The hammock as in claim 1, said horizontal, rigid spreader members will laterally space said web extensions a distance apart that will allow support forces to be directed longitudinally along said opposing longitudinally elongated edge webbing; and said forces will be directed from first spreader member ends and extend, therefrom to the ends of second spreader member.

8. The hammock as in claim 1, said independent anchor web members couple with said longitudinally elongated edge webbing creating four selectively adjustable points of connection, two per longitudinal end, being selectively adjustable to shorten the effective length thereof for tensioning and lateral leveling of said sleeping platform between said upright load-bearing supports, without adjusting said independent anchor web member at the anchor source.

9. The hammock as in claim 8, said independent anchor web members being of similar material to said longitudinally elongated edge webbing; said members allow full encirclement of said upright load-bearing supports, at minimum 540 degrees, and extend from said upright load-bearing supports, creating two support members which will couple with said web extensions, thus creating two support axes.

10. The hammock, as in claim 3, first and second longitudinally elongated edge webbing, coupled to said first and second independent anchor web members utilizing said first, second, third, and fourth longitudinal web extensions and furthermore applying lateral spreader force utilizing said horizontal, rigid spreader members creates a construction of continuous support, independent of said sleeping platform, to which said sleeping platform is affixed.

11. The hammock, as in claim 1, comprising end pockets laterally affixed to said lateral end edges of said sleeping platform; a sleeve being sewn transversely to one lateral edge of each said pocket creating an elongated channel made sufficiently large to permit said horizontal, rigid spreader member to pass; the opposing lateral edge of each said pocket being affixed to the sleeping platform lateral end edges by essentially sewing said pocket edge transversely to said sleeping platform lateral end edges; said horizontal, rigid spreader member being inserted into a first spreader receptacle, thence through said pocket sleeve, thence inserted into a second spreader receptacle, thus creating a repository for the occupant's personal effects.

* * * * *